US010638853B2

(12) United States Patent
Nolte et al.

(10) Patent No.: US 10,638,853 B2
(45) Date of Patent: May 5, 2020

(54) MATTRESS-RETENTION ASSEMBLY

(71) Applicant: L&P PROPERTY MANAGEMENT COMPANY, South Gate, CA (US)

(72) Inventors: Kevin Nolte, Joplin, MO (US); Cody McCormick, Diamond, MO (US)

(73) Assignee: L&P Property Management Company, South Gate, CA (US)

( * ) Notice: Subject to any disclaimer, the term of this patent is extended or adjusted under 35 U.S.C. 154(b) by 233 days.

(21) Appl. No.: 15/879,708

(22) Filed: Jan. 25, 2018

(65) Prior Publication Data

US 2019/0223613 A1 Jul. 25, 2019

(51) Int. Cl.
*A47C 21/02* (2006.01)
*A47C 27/08* (2006.01)

(52) U.S. Cl.
CPC ..... *A47C 21/026* (2013.01); *A47C 27/081* (2013.01)

(58) Field of Classification Search
CPC ..... A47C 21/026; A47C 27/081
See application file for complete search history.

(56) References Cited

U.S. PATENT DOCUMENTS 8,991,006 B2 * 3/2015 Masanek, Jr. ..... B60N 3/044 16/4
2008/0263775 A1 * 10/2008 Clenet ..... A47C 21/003 5/694
2018/0125259 A1 * 5/2018 Peterson ..... A47C 27/002

* cited by examiner

*Primary Examiner* — David R Hare
*Assistant Examiner* — Adam C Ortiz
(74) *Attorney, Agent, or Firm* — Shook Hardy & Bacon, LLP

(57) ABSTRACT

A mattress-retention assembly is provided that prevents a mattress from moving on an adjustable bed during articulation. The assembly includes a receiver plate coupled to adjustable mattress, where the receiver plate has a first coupling mechanism associated with an interior passage. The assembly further includes a grommet, having a hollow interior, disposed within the decking on the bed. The assembly further includes a male connector, having a second coupling mechanism that attaches to the first coupling mechanism of the receiver plate.

12 Claims, 6 Drawing Sheets

MATTRESS-RETENTION ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention generally relates to an arrangement for securing a mattress on an automated articulating bed. More particularly, the invention relates to a mattress-retention system used to prevent a mattress from moving on the base of an automated bed during articulation.

BACKGROUND OF THE INVENTION

Automated, articulating beds are increasing in popularity and use. In a typical adjustable bed, a base with a series of connected panels is moved into a variety of positions. The mattress rests on top of this base. It is desirable to prevent the mattress from moving with respect to the base, to keep the mattress in the correct position on the bed. A variety of methods are used to prevent a mattress from shifting past the edge of an automated bed foundation. Traditional mattress-retention methods include foot retainer bars, zippers, Velcro®, pockets, and non-slip fabrics or surfaces. Many of these methods help prevent a mattress from moving with respect to the base, during base articulation, such as during articulation of a Power Foundation from Leggett & Platt®. One of the main drawbacks of many of these retention methods is that they may be unsightly to a user, and may complicate the use of traditional bedding materials such as sheets or blankets on the bed. Most consumers would prefer the adjustable bed to look as much like a "normal" non-adjustable bed as possible.

Additionally, there may be mattress designs that would benefit from an easy access port from under the bed base, and through the bed base, into the interior of the mattress. As one example, mattresses filled with air, or some type of fluid, might benefit from such access.

Accordingly, a need exists for a reliable mattress-retention mechanism for use with an automated bedding system, which addresses the foregoing and other problems.

BRIEF SUMMARY OF THE INVENTION

The present invention generally relates to a mattress-retention assembly that prevents a mattress from moving on an adjustable bed during articulation. The assembly includes a receiver plate coupled to adjustable mattress, where the receiver plate has a first coupling mechanism associated with an interior passage. The assembly further includes a grommet, having a hollow interior, disposed within the decking on the bed. The assembly further includes a male connector, having a second coupling mechanism that attaches to the first coupling mechanism of the receiver plate.

Additional objects, advantages, and novel features of the invention will be set forth in part in the description which follows, and in part will become apparent to those skilled in the art upon examination of the following, or may be learned by practice of the invention.

BRIEF DESCRIPTION OF SEVERAL VIEWS OF THE DRAWING

The present invention is described in detail below with reference to the attached drawing figures, wherein.

DETAILED DESCRIPTION OF THE INVENTION

Figure 1:
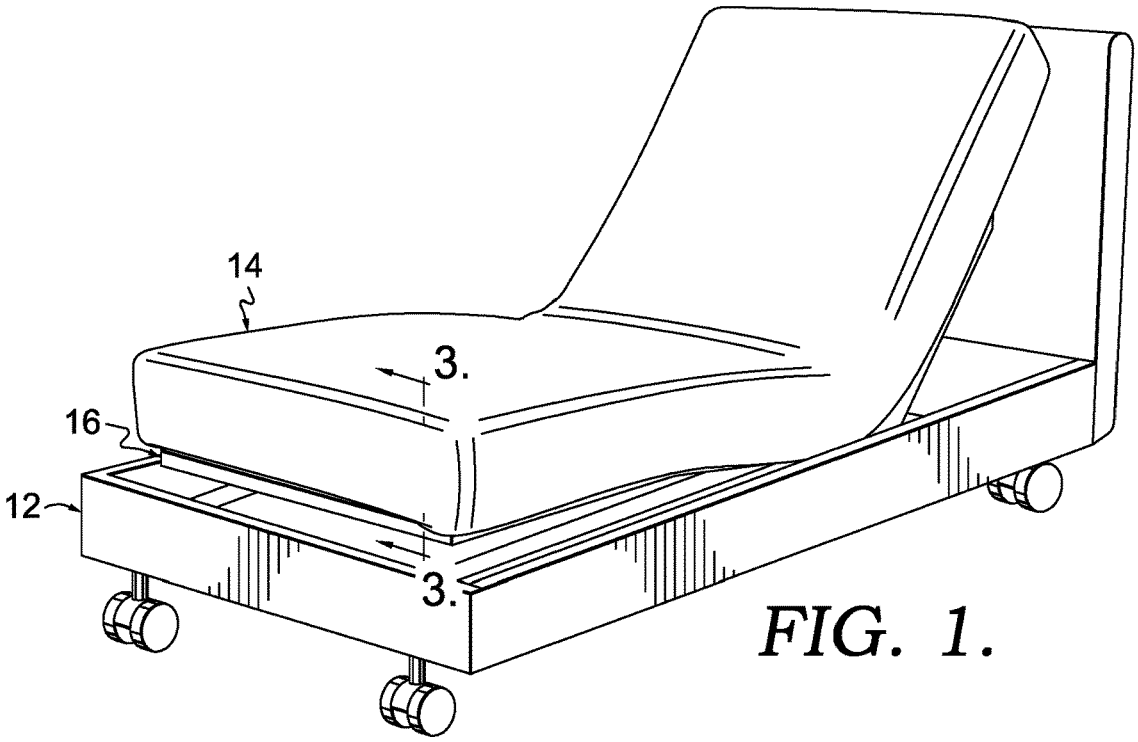
FIG. 1 is a perspective view of an adjustable bed, having a hidden mattress-retention assembly.

A mattress-retention assembly 10 is described below for use in maintaining a mattress 14 in place on an adjustable bed base 12. As shown in FIG. 1, and as understood by those of skill in the art, adjustable bed base 12 has a number of deck panels 16 that are movable to move the mattress 14 into a number of different positions. The mattress-retention assembly 10 prevents mattress 14 from sliding out of place relative to the bed base 12 and the panels 16.

Figure 2:
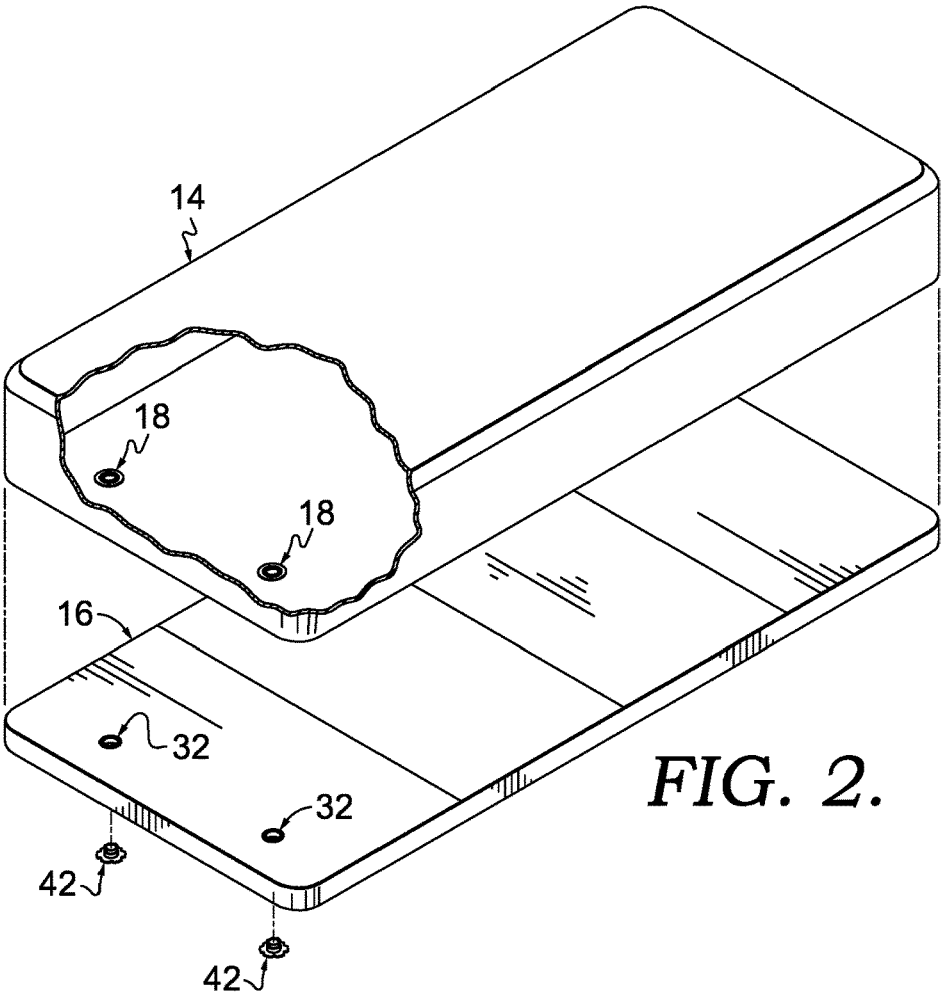
FIG. 2 is an exploded view of the mattress, base, and a mattress-retention assembly.
Figure 3:
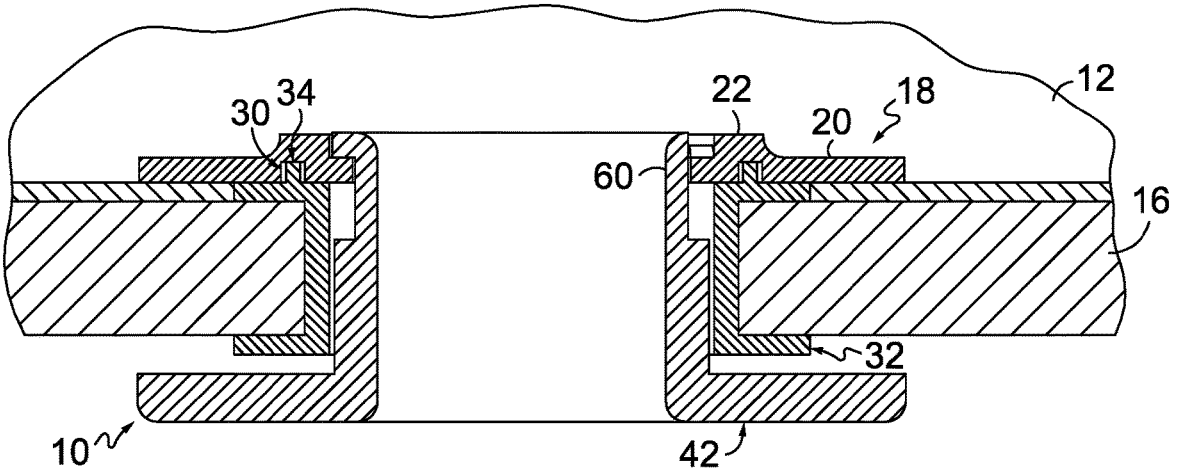
FIG. 3 is an enlarged partial cross-section, taken along line 3-3 of FIG. 1.

FIG. 2 shows an exploded view of one aspect of an exemplary mattress-retention assembly 10, with portions of the mattress 14 and base 12 cut-away to show details of construction. Mattress-retention assembly 10 includes a number of receiver plates 18 that are coupled to a corresponding mattress 14. The receiver plates 18 could be sewn in to the bottom of mattress 14, for example, or could otherwise be physically coupled to the mattress 14. Each receiver plate 18 has an outer flange 20, shown as a circular disc in FIG. 2. It should be understood that other shapes could be used as well. The flange 20 extends to an inner hub 22. The inner hub 22 defines a central interior passage 24. Passage 24 includes a pair of extending, arcuate retaining ribs 26. In a preferred aspect, the retaining ribs 26 are integrally formed with the receiver plate 18 and are symmetrically spaced about the interior diameter of the interior passage 24. At least one of the retaining ribs 26 has an extending detent 28, the use of which is further explained below. The underside of receiver plate 18 has a circular channel 30 formed therein that is used as a location aid.

Figure 5:
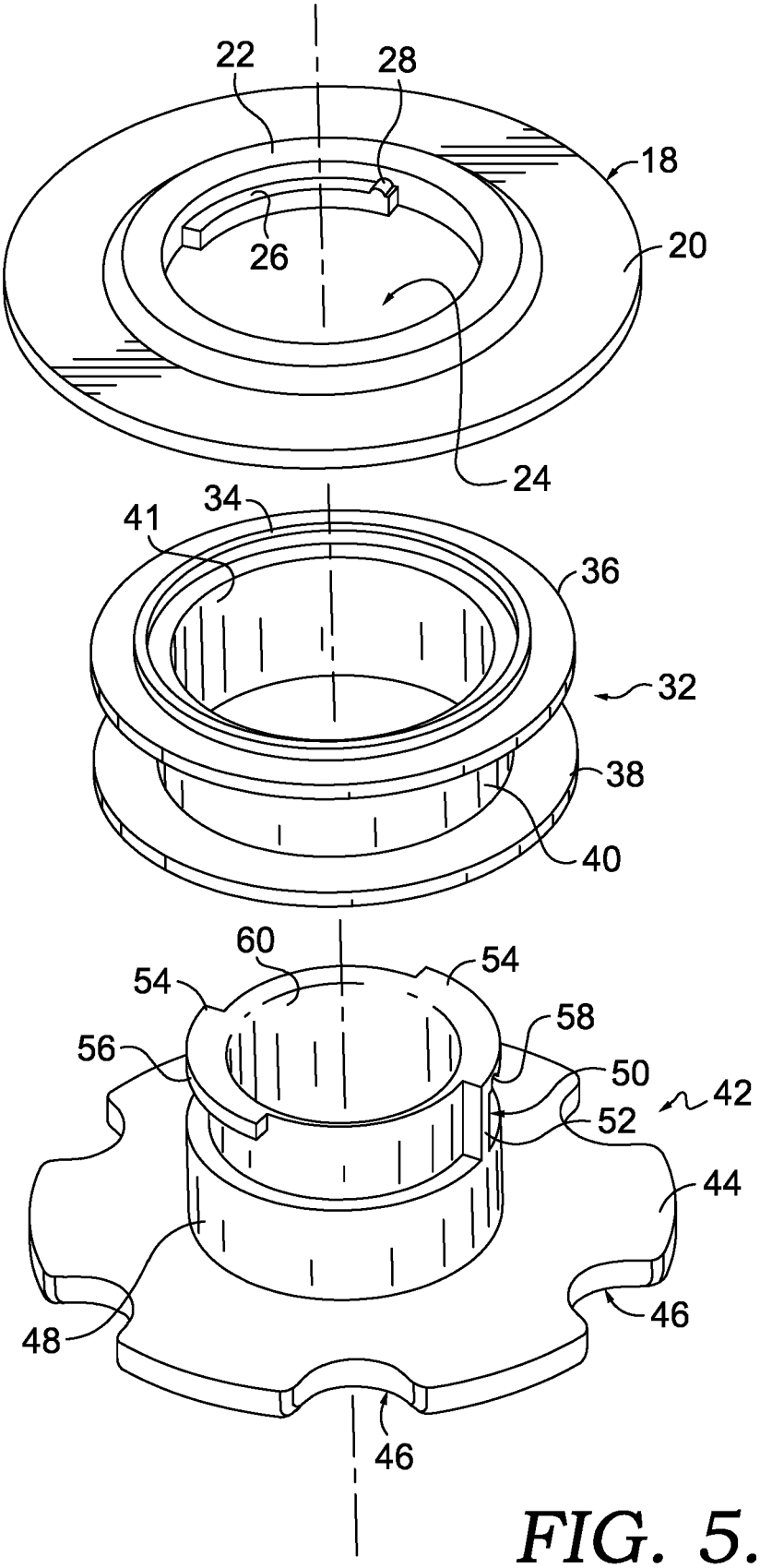
FIG. 5 is an exploded perspective view of the mattress retention assembly of FIGS. 3 and 4.

With continued reference to FIG. 2, the mattress-retention assembly further includes a grommet 32 that is coupled to the deck panel 16 of the base 12. Grommets 32 are located to correspond to the planned locations of the receiver plates 18. Each grommet 32, in one aspect, preferably has an upwardly protruding ring 34. Ring 34 can be an entire ring or could be formed as a number of spaced upwardly protruding arcuate portions. Ring 34 operates as an alignment aid to mate with the circular channel 30 in receiver plates 18. Each grommet 32 further has an upper flange 36 spaced from a lower flange 38 by a cylindrical body 40. Preferably, the body 40 has a height that matches the thickness of the deck panels 16 on which the mattress-retention assembly 10 will be used. As best seen in FIG. 5, grommet 32 has an interior wall 41 forming a cylindrical through-hole. Each grommet 32 is installed in a corresponding hole in the deck panel 16 at desired locations. The grommet 32 may be formed as two complimentary pieces that connect together, such that an upper piece could connect to a lower piece when installed in the hole in the deck panel 16. As one example, grommet 32 could be formed as an upper piece and a lower piece that snap-fit together when installed on a deck panel 16. Alternatively, the grommet 32 could be made of a material allowing it to be manipulated and inserted into the hole in deck panel 16, whereupon either the upper flange 36 or lower flange 38 returns to position. One exemplary grommet 32 in this aspect could be made from a rubberized material.

Figure 4:
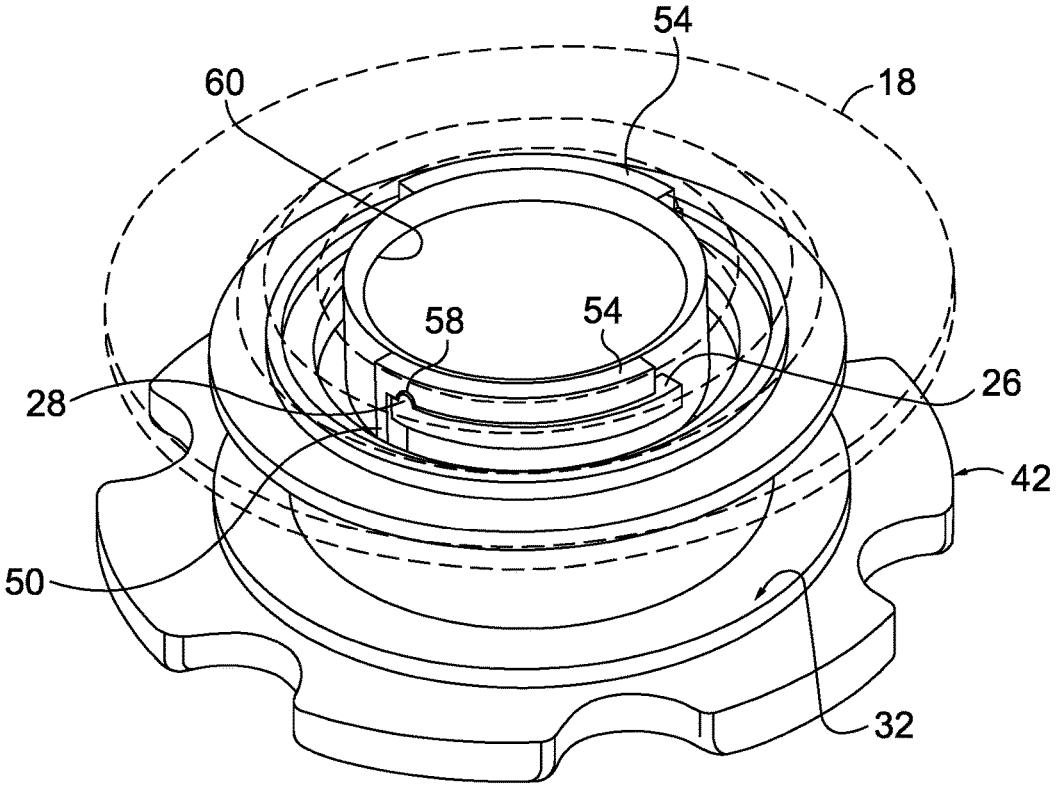
FIG. 4 is an enlarged perspective view of the mattress retention assembly of FIG. 3, shown with the receiver plate in dashed lines to reveal details of construction and fit.

As best seen in FIG. 5, the mattress-retention system 10 further includes a male connector 42. Male connector 42 has a disc-shaped base 44 with an outer diameter preferably greater than the diameter of the lower flange 38. The outer perimeter of the base 44 may be formed with a number of spaced arcuate cut-outs 46 that serve as finger grips. A cylindrical body 48 extends upwardly from the base 44. The lower section of the cylindrical body 48 preferably has an outer diameter slightly smaller than the diameter of the hole formed by interior wall 41 on grommet 32. The upper section of the cylindrical body 48 has a smaller outer diameter than the lower section and has a pair of vertical stop posts 50 that protrude outwardly from the outer diameter of the upper section of cylindrical body 48, such than an outer face 52 of stop posts 50 is flush with the outer diameter of the lower section of cylindrical body 48. The upper section of the cylindrical body 48 also has a pair of outwardly extending arcuate locking rims 54. Each rim 54, in one aspect, has an outer face 56 that extends to be flush with the outer diameter of the lower section of the cylindrical body 48, and with the outer face of stop posts 50. As best seen in FIGS. 4 and 5, the stop post 50 and adjacent rim 54 are preferably integrally formed. A notch 58 is formed in the rim 54, at the junction of stop post 50 and rim 54. Notch 58 is sized to correspond to the detent 28 in the receiver plate 18. The male connector 42 preferably has a central passage 60 formed therein, such that a through hole extends all the way through the male connector 42.

To secure the mattress 14 in place on the base 12, and thus the deck panels 16, the mattress 14 is aligned with the deck panels 16 such that the receiver plates 18 are aligned with the grommets 32. When properly aligned, the alignment rings 34 of the grommets 32 fit within the circular channels 30 of the receiver plates 18. The male connectors 42 are then used to connect the assembly. More specifically, a male connector 42 is inserted through a corresponding grommet 32, and the male connector is rotated such that the locking rims 54 fit in the space between the retaining ribs 26 of the receiver plates. With the locking rims 54 above the retaining ribs 26, the male connector 42 is rotated (aided by the cut-outs 46) such that the lower edge of the locking rims 54 rides along the upper edge of the retaining ribs 26. The male connector is so rotated until the detent 28 of the receiver place engages with the notch 58 of the male connector (FIG. 4). This process is repeated with a male connector 42 for each receiver plate 18. The number of receiver plates 18 in a mattress 14 can vary. As an example, a mattress 14 may have two receiver plates 18 at the foot end of the bed and two receiver plates 18 at the head end of the bed. A corresponding number of grommets 32 and male connectors 42 are then used to secure the mattress 14 in place. More, or fewer, mattress-retention assemblies 10 could also be used. With the mattress-retention assemblies in use, the mattress 14 is held in place on the base 12. The mattress is desirably located, due to the alignment of the receiver plates 18 with the grommets 32. In other words, when the receiver plates 18 are aligned with the corresponding grommets 32, the mattress 14 will be located on the deck panels 16 as intended by the manufacturer. Additionally, due to the central passage 60 in male connector 42, access is available to the interior of mattress 14 from below the deck panels 16.

Figure 6:
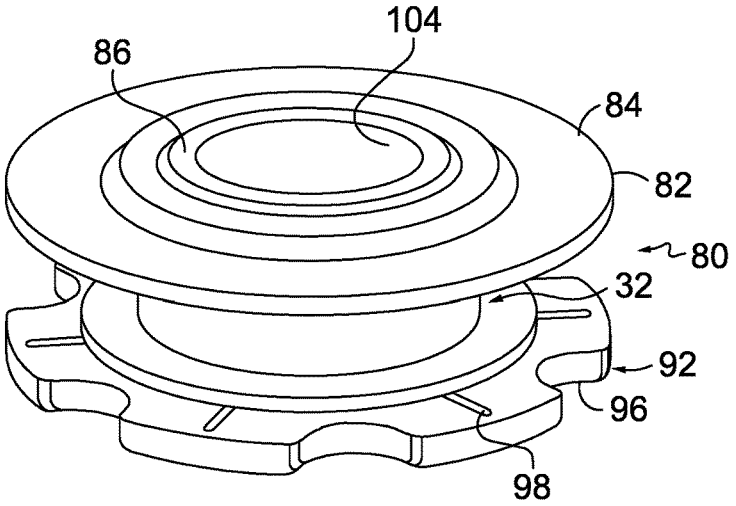
FIG. 6 is an enlarged perspective assembled view of a second aspect of a mattress retention assembly, shown without the base or mattress, for simplicity.
Figure 7:
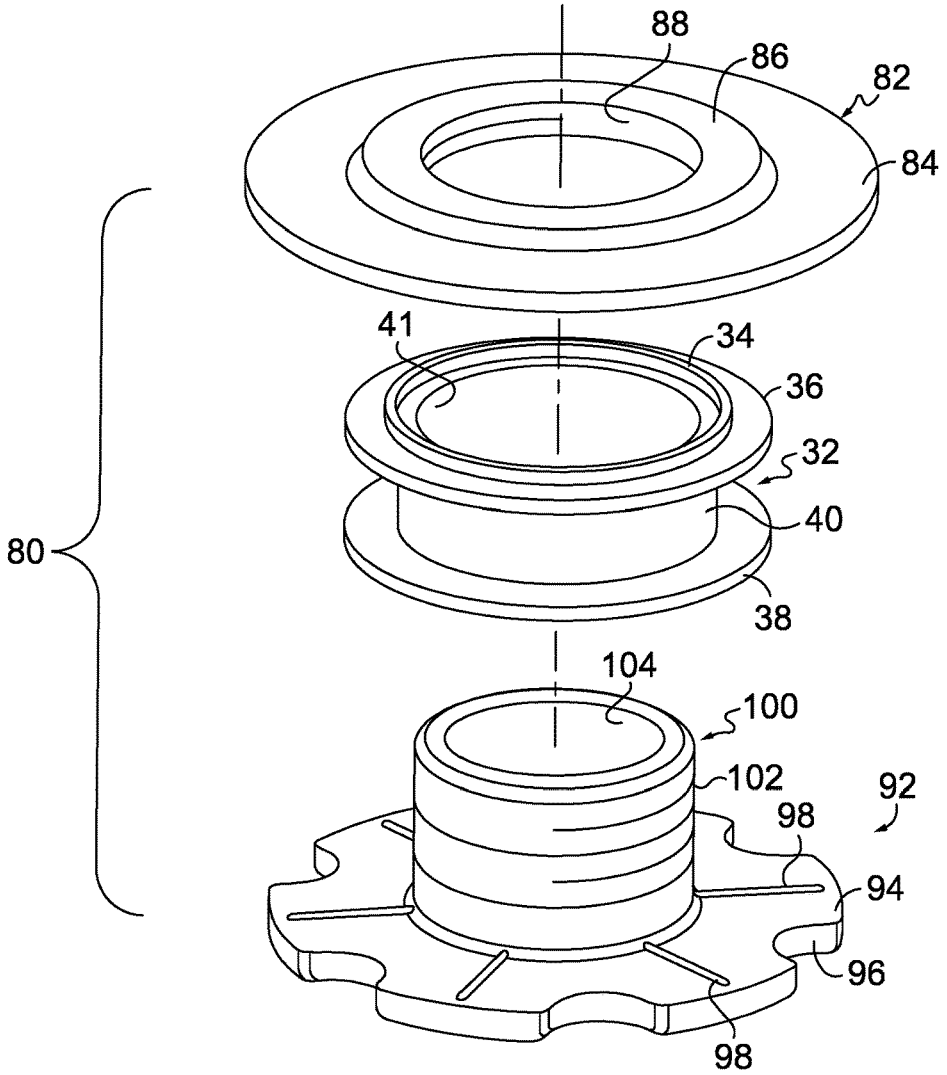
FIG. 7 is an exploded view of the mattress retention assembly of FIG. 6.

FIGS. 6 and 7, depict aspects of a mattress-retention assembly 80. In this aspect, mattress retention assembly 80 includes a number of receiver plates 82 that are coupled to a corresponding mattress 14. The receiver plates 82 could be sewn in to the bottom of mattress 14, for example, or could otherwise be physically coupled to the mattress 14. Each receiver plate 82 has an outer flange 84, shown as a circular disc in FIG. 2. It should be understood that other shapes could be used as well. The flange 84 extends to an inner hub 86. The inner hub 86 defines a central interior passage 88. Passage 88 in this aspect is threaded (as opposed to the retaining ribs 26 in FIGS. 1-5). The underside of receiver plate 82 has a circular channel 90 formed therein that is used as a location aid.

With continued reference to FIG. 7, the mattress-retention assembly further includes a grommet 32 that is coupled to the deck panel 16 of the base 12. These are the same grommets 32 described above with respect to FIGS. 1-5. Grommets 32 are located to correspond to the planned locations of the receiver plates 82. As described above, each grommet 32, preferably has an upwardly protruding ring 34. Ring 34 can be an entire ring or could be formed as a number of spaced upwardly protruding arcuate portions. Ring 34 operates as an alignment aid to mate with the circular channel 30 in receiver plates 18. Each grommet 32 further has an upper flange 36 spaced from a lower flange 38 by a cylindrical body 40. Preferably, the body 40 has a height that matches the thickness of the deck panels 16 on which the mattress-retention assembly 10 will be used. As best seen in FIG. 7, grommet 32 has an interior wall 41 forming a cylindrical through-hole. Each grommet 32 is installed in a corresponding hole in the deck panel 16 at desired locations. The grommet 32 may be formed as two complimentary pieces that connect together, such that an upper piece could connect to a lower piece when installed in the hole in the deck panel 16. As one example, grommet 32 could be formed as an upper piece and a lower piece that snap-fit together when installed on a deck panel 16. Alternatively, the grommet 32 could be made of a material allowing it to be manipulated and inserted into the hole in deck panel 16, whereupon either the upper flange 36 or lower flange 38 returns to position. One exemplary grommet 32 in this aspect could be made from a rubberized material.

As best seen in FIG. 7, the mattress-retention assembly 80 further includes a male connector 92. Male connector 92 has a disc-shaped base 94 with an outer diameter preferably greater than the diameter of the lower flange 38. The outer perimeter of the base 94 may be formed with a number of spaced arcuate cut-outs 96 that serve as finger grips. The top surface of base 94 preferably has, in one aspect, a series of spaced ridges 98 that protrude upwardly from the base 94. In one exemplary aspect, there is one ridge 98 between each cut-out 96. A cylindrical body 100 extends upwardly from the base 94. The lower section of the cylindrical body 100 preferably has an outer diameter slightly smaller than the diameter of the hole formed by interior wall 41 on grommet 32. The upper section of the cylindrical body 100 is formed with threads 102 to mate with the threads in interior passage 88. The male connector 92 preferably has a central passage 104 formed therein, such that a through hole extends all the way through the male connector 92.

To secure the mattress 14 in place on the base 12, and thus the deck panels 16, the mattress 14 is aligned with the deck panels 16 such that the receiver plates 82 are aligned with the grommets 32. When properly aligned, the alignment rings 34 of the grommets 32 fit within the circular channels 90 of the receiver plates 82. The male connectors 92 are then used to connect the assembly. More specifically, a male connector 92 is inserted through a corresponding grommet 32, and the male connector is rotated such that the threads 102 fit within the threads on in the interior passage 88. The male connector is so rotated until the upper surface of the base, and specifically the ridges 98, come in contact with the lower surface of the grommet 32. The ridges 98 act as an aide to prevent loosening of the male connector 92. This process is repeated with a male connector 92 for each receiver plate 82. The number of receiver plates 82 in a mattress 14 can vary. As an example, a mattress 14 may have two receiver plates 82 at the foot end of the bed and two receiver plates 82 at the head end of the bed. A corresponding number of grommets 32 and male connectors 92 are then used to secure the mattress 14 in place. More, or fewer, mattress-retention assemblies 80 could also be used. With the mattress-retention assemblies in use, the mattress 14 is held in place on the base 12. The mattress is desirably located, due to the alignment of the receiver plates 80 with the grommets 32. In other words, when the receiver plates 80 are aligned with the corresponding grommets 32, the mattress 14 will be located on the deck panels 16 as intended by the manufacturer. Additionally, due to the central passage 104 in male connector 92, access is available to the interior of mattress 14 from below the deck panels 16.

Figure 8:
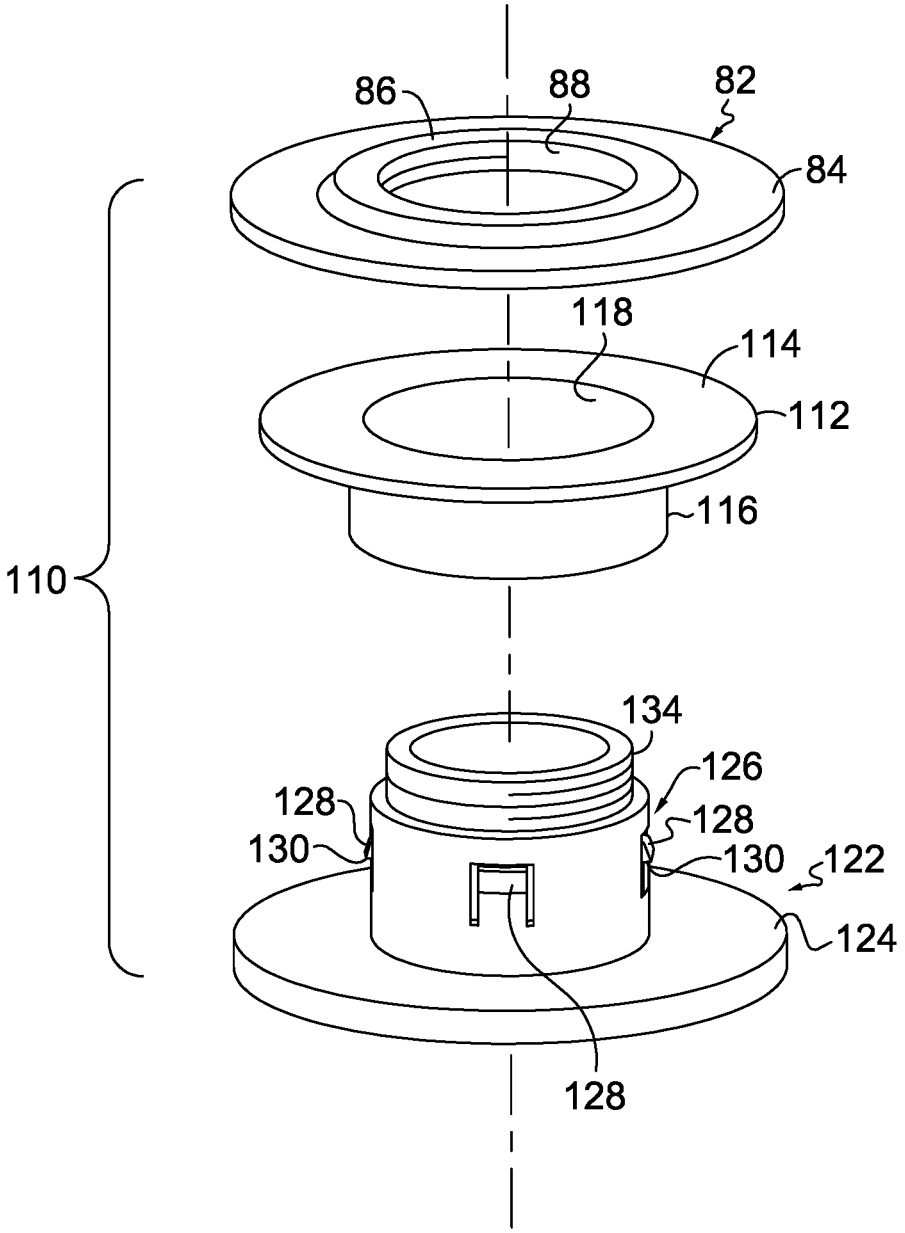
FIG. 8 is an exploded perspective view, similar to FIG. 7, showing yet another aspect.
Figure 9:
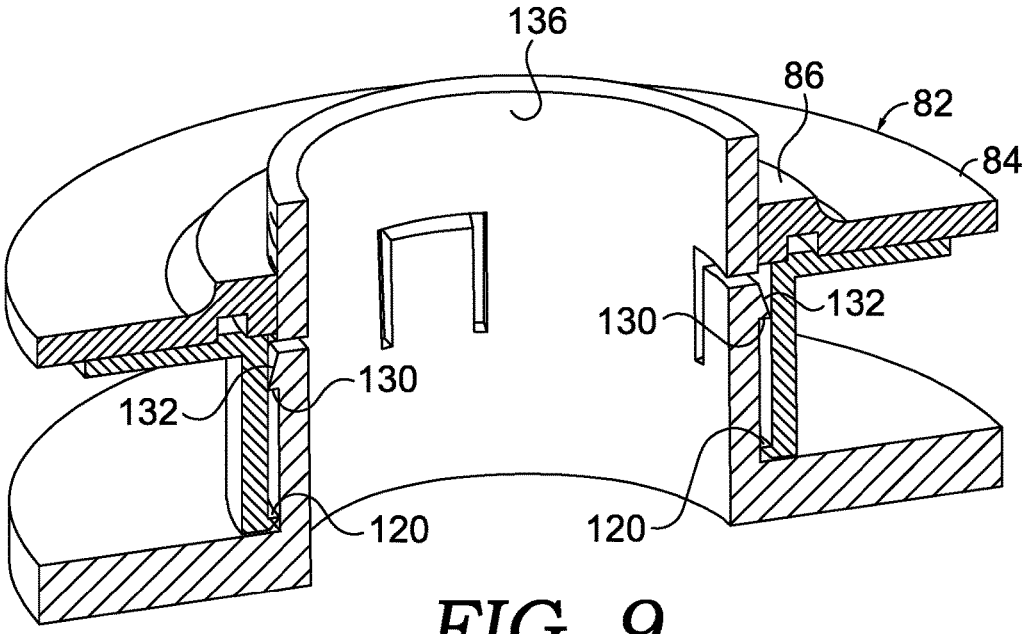
FIG. 9 is an enlarged, partial, cross-sectional view of the mattress retention assembly of FIG. 8, shown in the engaged position.
Figure 10:
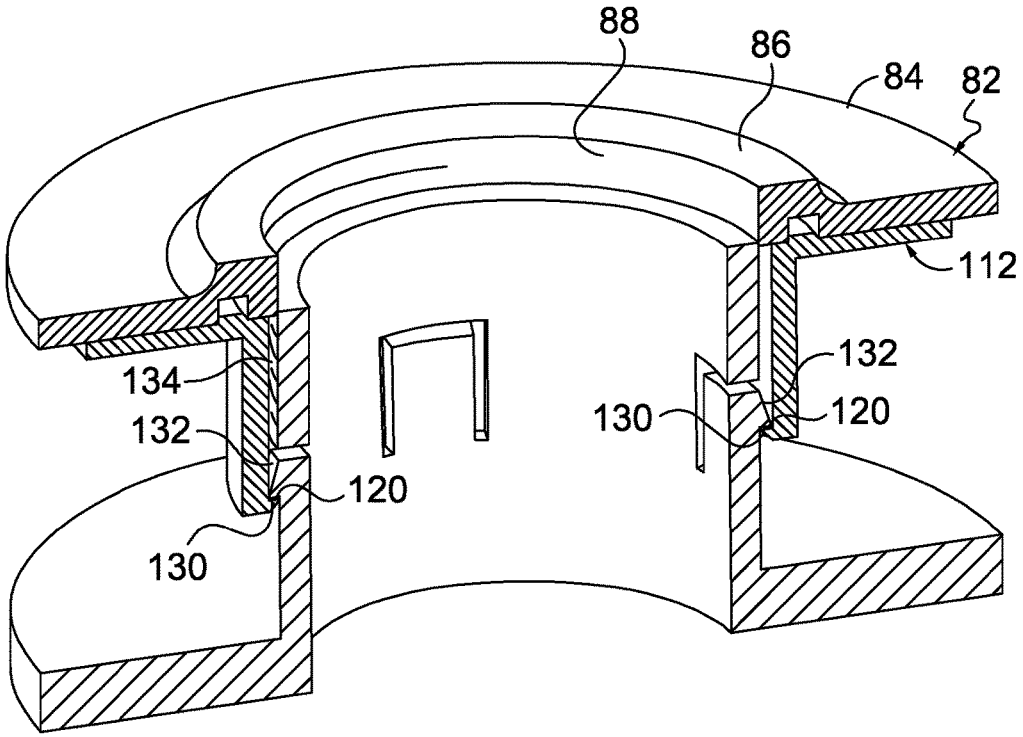
FIG. 10 is a view similar to FIG. 9, showing the disengaged position.

FIGS. 8-10, depict aspects of a mattress-retention assembly 110. In this aspect, mattress retention assembly 110 includes a number of receiver plates 82 that are coupled to a corresponding mattress 14. The receiver plates 82 are the same as those described above with respect to FIGS. 6-7, and so could be sewn in to the bottom of mattress 14, for example, or could otherwise be physically coupled to the mattress 14. Each receiver plate 82 has an outer flange 84, shown as a circular disc in FIG. 9. It should be understood that other shapes could be used as well. The flange 84 extends to an inner hub 86. The inner hub 86 defines a central interior passage 88. Passage 88 in this aspect is threaded (as opposed to the retaining ribs 26 in FIGS. 1-5). The underside of receiver plate 82 may have a circular channel 90 formed therein that is used as a location aid.

With continued reference to FIG. 9, the mattress-retention assembly 110 further includes a grommet 112 that extends through a hole in the deck panel 16 of the base 12. Grommets 112 are located to correspond to the planned locations of the receiver plates 82. Each grommet 112 has an upper flange 114 with a cylindrical body 116 extending below the upper flange 114. The upper flange may be formed with a locating ring, similar to ring 34 described above with respect to FIG. 7. Preferably, the body 116 has a height that matches the thickness of the deck panels 16 on which the mattress-retention assembly 110 will be used. As best seen in FIG. 8, grommet 112 has an interior wall 118 forming a cylindrical through-hole. At, or near, the bottom of the interior wall is an inwardly extending lip 120. Lip 120 thus extends into the through-hole formed by the interior wall 118.

Each grommet 112 is installed in a corresponding hole in the deck panel 16 at desired locations. The grommet 112, not having a lower flange like grommets 32, can simply be inserted into a hole in the deck panel 16 from the top.

As best seen in FIG. 8, the mattress-retention assembly 110 further includes a male connector 122. Male connector 122 has a disc-shaped base 124 with an outer diameter preferably greater than the diameter of the hole in the deck panel 16. A cylindrical body 126 extends upwardly from the base 124. The lower section of the cylindrical body 126 preferably has an outer diameter slightly smaller than the diameter of the hole formed by interior wall 118 on grommet 112. The lower section of the cylindrical body 126 has series of circumferentially spaced tabs 128 formed therein. The tabs 128 have a locking edge 130. As best seen in FIG. 8, the locking edge 130 of each tab 128 is biased outwardly, but the cylindrical body 126 has a relief channel behind the locking tab 128, allowing the locking edge 130 to move radially inwardly upon some inward force imparted to the tab 128. Preferably, each locking tab 128 has an angled cam surface 132 to facilitate this inward force, as is more-fully described below. The upper section of the cylindrical body 126 is formed with threads 134 to mate with the threads in interior passage 88 of receiver plates 82. The male connector 122 preferably has a central passage 136 formed therein, such that a through hole extends all the way through the male connector 122.

The grommets 112 and male connectors 122 can be coupled to deck panels 16 before shipping, if desired. The grommets 112 are placed through corresponding holes in the deck panels 16. The male connectors 122 are inserted into the grommets 122. As the male connectors 122 are being inserted into the grommets 122, the cam surface 132 of tabs 128 engages the lower-most edge of the grommets 122, near lip 120. The cam surface 132, along with the upward force, operates to move the tabs 128 inwardly, such that the locking edge 130 of the tabs 128 moves inwardly to clear the lip 120. Once the locking edge 130 is clear of the lip 120, the lip 120, and locking edge 130 operate to maintain the male connector 122 in place. In other words, the male connector 122 will not fall out of the grommet 112, due to the engagement of the lip 120 and the locking edge 130 (FIG. 10). To secure the mattress 14 in place on the base 12, and thus the deck panels 16, the mattress 14 is aligned with the deck panels 16 such that the receiver plates 82 are aligned with the grommets 112 and male connectors 122. When properly aligned, the alignment rings of the grommets (if present) fit within the circular channels 90 of the receiver plates 82. The male connectors 122 are then used to connect the assembly. More specifically, the male connectors 122 are moved upwardly, and rotated, such that the threads 134 fit within the threads in the interior passage 88. The male connector 112 is so rotated until the upper surface of the base comes in contact with the lower surface of the grommet 112 or the deck panel 16 (FIG. 9). This process is repeated with a male connector 122 for each receiver plate 82. The number of receiver plates 82 in a mattress 14 can vary. As an example, a mattress 14 may have two receiver plates 82 at the foot end of the bed and two receiver plates 82 at the head end of the bed. A corresponding number of grommets 112 and male connectors 122 are then used to secure the mattress 14 in place. More, or fewer, mattress-retention assemblies 110 could also be used. With the mattress-retention assemblies in use, the mattress 14 is held in place on the base 12. The mattress is desirably located, due to the alignment of the receiver plates 82 with the grommets 112. In other words, when the receiver plates 82 are aligned with the corresponding grommets 112, the mattress 14 will be located on the deck panels 16 as intended by the manufacturer. Additionally, due to the central passage 136 in male connector 122, access is available to the interior of mattress 14 from below the deck panels 16.

From the foregoing, it will be seen that this invention is one well adapted to attain all the ends and objects hereinabove set forth together with other advantages, which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A mattress-retention assembly, for retaining an adjustable mattress on a decking for an adjustable bed frame, comprising:

at least one receiver plate coupled to a bottom of the adjustable mattress, the at least one receiver plate having an outer flange surrounding an interior passage and a threaded surface on the interior passage of the at least one receiver plate;

at least one grommet disposed within the decking, the at least one grommet having a hollow interior extending from the bottom to the top of the decking, wherein the hollow interior includes a lip extending radially inwardly into the hollow interior; and at least one male connector, having a base and a body extending upwardly from the base, the body matingly coupled to the at least one receiver plate, the body including a plurality of outwardly extending tabs having a locking edge that engages the lip on the at least one grommet to maintain a coupling between the at least one male connector and the at least one grommet, the body further including a threaded surface on the outer periphery of the body such that the threaded surface of the body on the at least one male connector can be threaded into the threaded surface on the interior passage of the at least one receiver plate to couple the at least one male connector to the at least one receiving plate, the base having a top surface, and wherein the top surface includes a plurality of spaced, upwardly extending ridges;

wherein when the at least one receiver plate is aligned with the at least one grommet, the body of the male connector is adapted to be placed through the at least one grommet, coupling the mattress to the decking as the at least one receiver plate and the body of the male connector engage.

2. The mattress-retention assembly of claim 1, wherein the at least one receiver plate has a bottom surface with an annular channel formed therein, and wherein the at least one grommet has an upper surface with an upwardly protruding annular ring, the annular ring mating with the annular channel when the at least one receiver plate is aligned with the at least one grommet.

3. The mattress-retention assembly of claim 1, wherein the at least one receiver plate comprises at least two circumferentially spaced, arcuate, retaining ribs extending radially into the interior passage of the at least one receiver plate, and wherein the body of the at least one male connector comprises at least two circumferentially spaced, arcuate, locking rims formed such that the locking rims fit between the space between retaining ribs in a first orientation, and the locking rims engage the retaining ribs in a second orientation to couple the at least one male connector to the at least one receiving plate.

4. The mattress-retention assembly of claim 3, wherein the base of the at least one male connector includes a series of spaced cut-outs about the periphery of the base.

5. The mattress-retention assembly of claim 1, wherein the at least one male connector is formed with a central passage extending from the base through the body such that when the at least one male connector is coupled to the at least one receiver plate, a passage extends from a lower surface of the decking into an interior of the mattress.

6. A mattress-retention assembly, for retaining an adjustable mattress on a decking for an adjustable bed frame where the decking has at least one hole therethrough, comprising:

at least one receiver plate coupled to a bottom of the adjustable mattress positioned to align with the hole in the decking, the at least one receiver plate having an interior passage wherein the interior passage includes a lip extending radially inwardly into the interior passage and at the least one receiver plate comprises a threaded surface on the interior passage of the at least one receiver plate; and at least one male connector, having a base and a body extending upwardly from the base, the body matingly coupled to the at least one receiver plate, the body including a plurality of outwardly extending tabs having a locking edge that engages the lip on the at least one grommet to maintain a coupling between the at least one male connector and the at least one receiver plate, the body further including a threaded surface on the outer periphery of the body such that the threaded surface of the body on the at least one male connector can be threaded into the threaded surface on the interior passage of the at least one receiver plate to couple the at least one male connector to the at least one receiving plate, the base having a top surface, and wherein the top surface includes a plurality of spaced, upwardly extending ridges, wherein when the at least one receiver plate is aligned with the hole in the decking, the body of the male connector is adapted to be placed through the hole in the decking, coupling the mattress to the decking of the at least one receiver plate and the body of the male connector engage.

7. The mattress-retention assembly of claim 6, further comprising at least one grommet disposed within the hole in the decking, the at least one grommet having a hollow interior extending from the bottom to the top of the decking, wherein the male connector extends through the at least one grommet to couple the male connector to the at least one receiver plate.

8. The mattress-retention assembly of claim 7, wherein the at least one receiver plate has a bottom surface with an annular channel formed therein, and wherein the at least one grommet has an upper surface with an upwardly protruding annular ring, the annular ring mating with the annular channel when the at least one receiver plate is aligned with the at least one grommet.

9. The mattress-retention assembly of claim 8, wherein the at least one receiver plate comprises at least two circumferentially spaced, arcuate, retaining ribs extending radially into the interior passage of the at least one receiver plate, and wherein the body of the at least one male connector comprises at least two circumferentially spaced, arcuate, locking rims formed such that the locking rims fit between the space between retaining ribs in a first orientation, and the locking rims engage the retaining ribs in a second orientation to couple the at least one male connector to the at least one receiving plate.

10. The mattress-retention assembly of claim 9, wherein the base of the at least one male connector includes a series of spaced cut-outs about the periphery of the base.

11. The mattress-retention assembly of claim 10, wherein the at least one male connector is formed with a central passage extending from the base through the body such that when the at least one male connector is coupled to the at least one receiver plate, a passage extends from a lower surface of the decking into an interior of the mattress.

12. The mattress-retention assembly of claim 7, wherein the interior of the at least one grommet includes a lip extending radially inwardly into the interior, and wherein the body of the at least one male connector includes a plurality of outwardly extending tabs having a locking edge that engages the lip on the at least one grommet to maintain a coupling between the at least one male connector and the at least one grommet.

* * * * *